United States Patent [19]

McClure

[11] 4,069,873

[45] Jan. 24, 1978

[54] APPARATUS FOR FIRE EXTINGUISHING SYSTEM FOR FLOATING-ROOF TANKS

[76] Inventor: William F. McClure, SRA Box 1707, Anchorage, Alaska 99507

[21] Appl. No.: 674,172

[22] Filed: Apr. 6, 1976

[51] Int. Cl.[2] ..... A62C 13/34; A62C 37/34

[52] U.S. Cl. ..... 169/51; 137/209; 137/360; 169/56; 169/66; 169/9; 169/16

[58] Field of Search ..... 169/5, 9, 11, 16, 17, 169/19, 20, 26, 30, 51, 54, 56, 57, 59, 60, 66, 67, 68, 85; 239/71, 76; 137/209, 70–72, 356, 360, 362, 377; 138/110; 340/227 C, 229, 239 S, 240

[56] References Cited

U.S. PATENT DOCUMENTS

| | | | |
|---|---|---|---|
| 2,349,464 | 5/1944 | Rider et al. | 169/17 |
| 2,692,649 | 10/1954 | McCreary | 169/57 |
| 3,213,948 | 10/1965 | Eckels | 138/110 X |
| 3,251,419 | 5/1966 | Howard | 169/9 |
| 3,415,024 | 12/1968 | Kotlarz | 137/360 X |
| 3,741,309 | 6/1973 | McCulloch | 169/66 X |
| 3,896,881 | 7/1975 | De Boer | 169/66 |
| 3,965,988 | 6/1976 | Wesson | 169/9 |

FOREIGN PATENT DOCUMENTS

| | | | |
|---|---|---|---|
| 1,001,873 | 2/1952 | France | 169/66 |

*Primary Examiner*—John J. Love
*Assistant Examiner*—Andres Kashnikow
*Attorney, Agent, or Firm*—Burns, Doane, Swecker & Mathis

[57] ABSTRACT

A fire extinguishing system for use especially on a floating roof tank includes an enclosure secured to the tank roof. The enclosure carries an agent tank, an expellant tank and an accumulator tank. The agent tank contains fire extinguishing agent. The expellant tank contains pressurized expellant fluid. An expellant conduit extends from the expellant tank to an inlet of the agent tank. A sprayer duct is connected to an outlet of the agent tank and is arranged along one protected zone of the roof rim. A control valve is disposed in the expellant conduit. A heat sensitive pilot conduit is disposed along the protected zone and fluidly connects the expellant conduit with the control valve so that pressure from the expellant tank maintains the control valve closed. If the pilot conduit ruptures, agent is discharged. A bypass conduit connects the expellant conduit with the sprayer duct. Valve mechanism is provided for blocking passage of expellant fluid into the agent tank and for admitting passage of expellant fluid through the bypass conduit, enabling expellant fluid to be discharged from the sprayer duct during testing of the system. A plurality of mounting legs extend horizontally from the enclosure and along the tank roof and are secured to the tank roof. At least one of the legs includes an internal passage which receives the pilot conduit.

6 Claims, 6 Drawing Figures

APPARATUS FOR FIRE EXTINGUISHING SYSTEM FOR FLOATING-ROOF TANKS

BACKGROUND AND OBJECTS

This invention relates to fire extinguishing systems for oil storage tanks, especially floating roof tanks.

The storage of oil and other combustibles within large tanks has traditionally involved significant safety hazards due in part to the possibility of fires and explosions produced by vapor accumulating between the oil and the tank roof. These dangers have been greatly reduced by the use of floating roof tanks in which the roof is permitted to float with changing oil levels to minimize the voids which can occur therebetween. A flexible seal is disposed between the outer rim of the roof and the side of the tank. Such floating roof tanks, however, are not completely danger-free. Upon occasion, fires have broken out along the rim seal where vapors have collected. If allowed to burn uncontrolled, these fires can produce serious catastrophes.

Systems have been proposed which are intended to detect and extinguish fires on floating roof tanks. See, for example, U.S. DeBoer Pat. No. 3,896,881, issued July 29, 1975, and U.S. McCulloch Pat. No. 3,741,309, issued June 26, 1973 for systems of this type. It is common to arrange a series of sprayers around the periphery of the tank roof. The sprayers are connected to a continually pressurized fire extinguishing agent. A temperature sensitive element on each sprayer reacts to high temperature conditions to open its associated sprayer, causing agent to be emitted. A system of this type is subject to certain drawbacks. For one thing, systems in which the agent is continually pressurized generally require special equipment for refilling the agent containers. Thus, added expense and complexity is involved in maintaining the system once installed.

A further problem is produced by the nature of rim seal fires which can occur. Often, such fires begin as very low order fires depending upon wind conditions, the type of combustible being stored, and other factors. A system in which only the sprayer closest to the fires is activated can be fooled by a migrating fire which does not activate other sprayers until all of the extinguishing agent has been depleted through the initially activated sprayer. A system has been proposed in which all of the sprayers around the entire rim periphery are activated simultaneously when a fire is sensed, but this is costly and leaves the entire rim unprotected after the extinguishing has been depleted.

An additional area of concern involves system integrity. A system which sits unactivated for long periods can develop leaks, clogs, etc. which may go unnoticed. Of course, the extinguishing agent can be expelled occasionally to test the system, but this involves considerable expense.

It would also be desirable to provide a system which can be securely fastened to the roof so as to minimize potential dangers due to high winds and to guard against damage by careless workers who may be active in the area of the system.

It is, therefore, an object of the present invention to eliminate or at least significantly alleviate problems of this nature.

It is another object of the invention to provide a fire extinguishing system for floating roof tanks which can be easily maintained without the need for special equipment.

It is a further object of the invention to provide a fire extinguishing system for floating roof tanks which effectively guards against migrating, low order rim seal fires.

It is still another object of the invention to provide a fire extinguishing system for floating roof tanks which is securely mounted in a manner providing optimum component protection.

It is yet another object of the invention to provide a fire extinguishing system for floating roof tanks which can be periodically tested in an effective yet economical manner.

BRIEF SUMMARY

These objects are achieved by the present invention which involves a fire extinguishing system for use especially on a floating roof tank. The system includes an enclosure secured to the tank roof. The enclosure carries an agent tank, an expellant tank and an accumulator tank. The agent tank contains fire extinguishing agent and includes an expellant inlet and an agent outlet. The expellant tank contains pressurized expellant fluid. An expellant conduit extends from the expellant tank to the inlet of the agent tank. A sprayer duct is connected to the outlet of the agent tank and is arranged along one protected zone of the roof rim. A control valve is disposed in the expellant conduit. A flow control member is disposed in the expellant conduit upstream of the control valve for metering the rate of flow of expellant fluid. The accumulator communicates with the expellant conduit upstream of the control valve and downstream of the flow control member so that the accumulator is normally pressurized by the expellant tank. A heat sensitive pilot conduit is disposed along the protected zone and fluidly connects the expellant conduit with the control valve so that pressure from the expellant tank maintains the control valve closed against an opening bias. Fire-produced rupture of the pilot conduit enables the control value to open and admit a surge of pressure from the accumulator to the agent tank to rapidly displace agent into the sprayer duct and thereafter admit metered pressure from the expellant tank to discharge the agent from the sprayer duct at controlled rate.

A plurality of such systems are disposed on the tank roof to protect individual zones along the rim. The sprayer duct of each system includes spaced sprayer nozzles, all of which eject agent when a fire is detected in that zone.

A plurality of mounting legs extend horizontally from the enclosure and along the tank roof and are secured to the tank roof. At least one of the legs includes an internal passage which receives the pilot conduit.

The agent tank includes a fill port. By exposing the fill port, the agent tank can be replenished by the addition of unpressurized agent with the need for special equipment.

A bypass conduit connects the expellant conduit with the sprayer duct. Valve mechanism is provided for blocking passage of expellant fluid into the agent tank and for admitting passage of expellant fluid through the bypass conduit, enabling expellant fluid to be discharged from the sprayer duct during testing of the system.

THE DRAWINGS

A preferred embodiment of the invention is disclosed in conjunction with the accompanying drawings in which.

DETAILED DESCRIPTION

Figure 4:
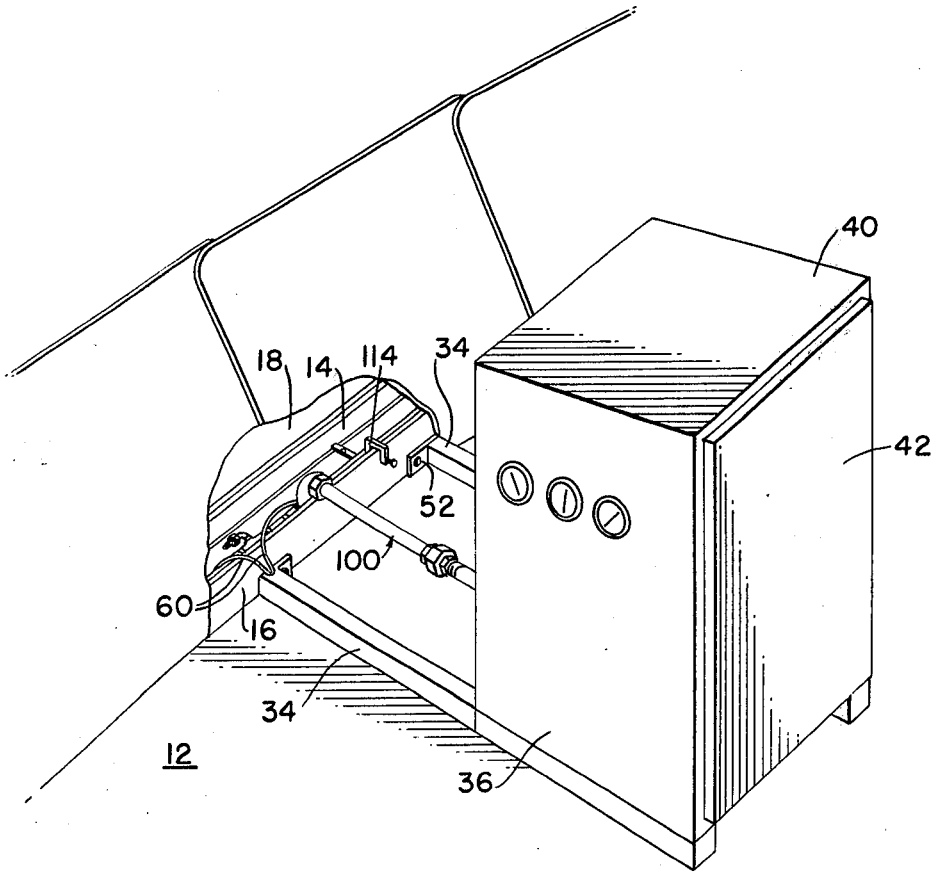
FIG. 4 is a perspective view of the storage compartment in a fully secured condition on the floating roof of a tank.

A preferred fire extinguishing arrangement according to the present invention is mounted upon an oil storage tank 10. The tank 10 is of the floating roof type in that the roof 12 thereof is arranged to rise and fall in a conventional manner in accordance with the level of oil disposed within the tank 10. A floating tank seal 14 is connected between an upstanding rim portion 16 of the tank roof and the cylindrical side wall 18 of the tank 10 (FIG. 4). It is in the location of this seal that dangerous vapors can tend to accumulate, resulting in the creation of rim seal fires around the periphery of the tank roof. If allowed to burn out of control, such fires can produce major catastrophes.

The preferred fire extinguishing arrangement includes a plurality of fire extinguishing systems 20, 22, 24 disposed in adjacent fashion around the periphery of the roof so as to provide protection for the entire roof periphery. There may be one, two or more such systems, with three systems being disclosed herein. Each of the systems 20, 22, 24 is identical and independently actuable, so that only one such system need be described in detail.

Figure 1:
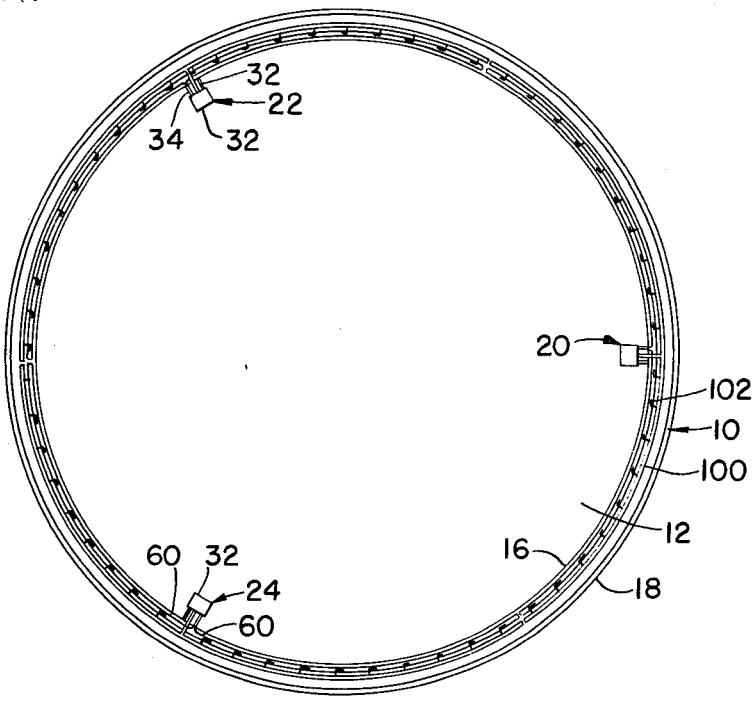
FIG. 1 is a plan view of a floating roof tank on which fire detecting systems according to the present invention are mounted.
Figure 2:
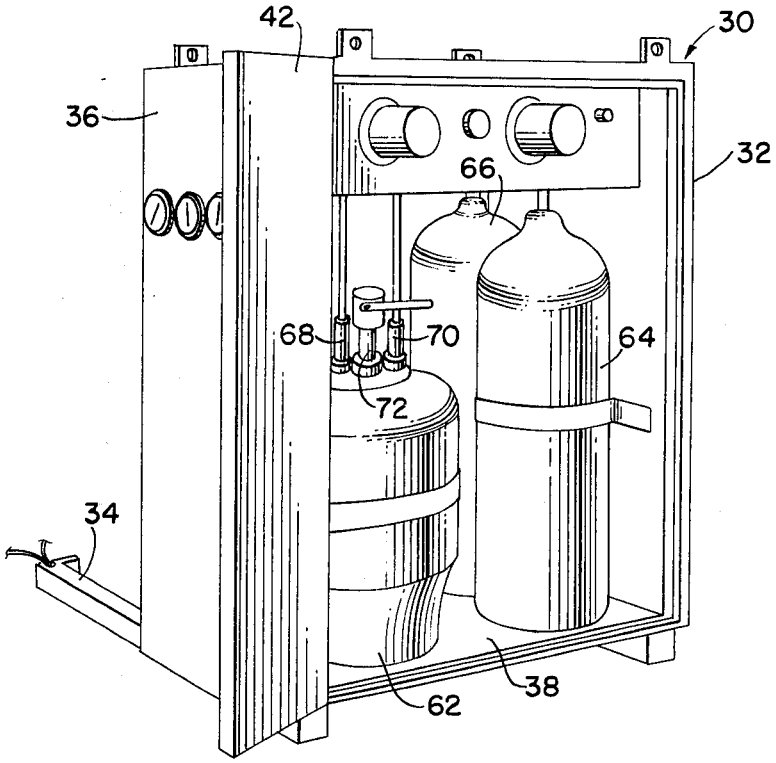
FIG. 2 is a perspective view of an extinguishing agent storage compartment of the present invention.
Figure 3:
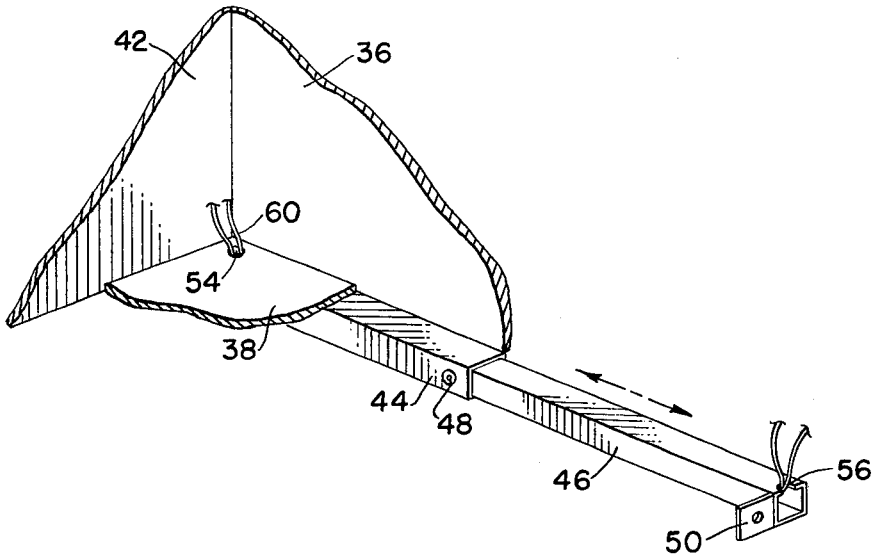
FIG. 3 is a fragmentary perspective view of a mounting leg for the storage compartment, with parts broken away for clarity.

The fire extinguishing system 20 includes a storage housing 30 comprising an enclosure 32 and a plurality of mounting legs 34 (FIGS. 2–4). The enclosure 32 includes four side walls 36, a bottom wall 38, a top wall 40 and a door 42. The enclosure 32 is seated upon and secured to inner ends of the mounting legs 34. The mounting legs 34 project essentially horizontally from the enclosure 32.

Each of the mounting legs 34 includes a pair of horizontally telescoping sections 44, 46. Each section is formed of rectangular, tubular sheet metal. An adjustment screw 48 is mounted in one side of the larger of the telescoping sections 44 and is frictionally engageable with a corresponding side of the smaller of the telescoping sections 46 so as to frictionally retain the latter against movement relative to the former. Upon loosening of the screw 48, the tubular sections 44, 46 may be telescopingly adjusted so as to vary the effective length of the leg 34.

At its outer end each mounting leg 34 has a flange 50 providing connection to the upstanding tank rim 16. The flange 50 extends laterally outwardly from a side wall of the smaller of the tubular sections 46. When installing the support leg to a new storage tank under construction, i.e., wherein operations such as drilling are not hazardous, aligned apertures can be formed through the flange and the roof rim to receive an anchoring bolt 52 or the like. For connecting the leg to an existing oil tank, a suitable clamp may be provided to clamp the flange to the rim 16.

At its inner end, the larger tubular section 44 includes an inlet opening 54. At its outer end, the smaller tubular section 46 includes an outlet slot 56. The interior of the support leg defines a passage for receiving one or more flexible pilot tubes 60 passing from the inlet opening 54 to the outlet slot 56. The tubes 60 themselves will be described subsequently in more detail.

Figure 6:
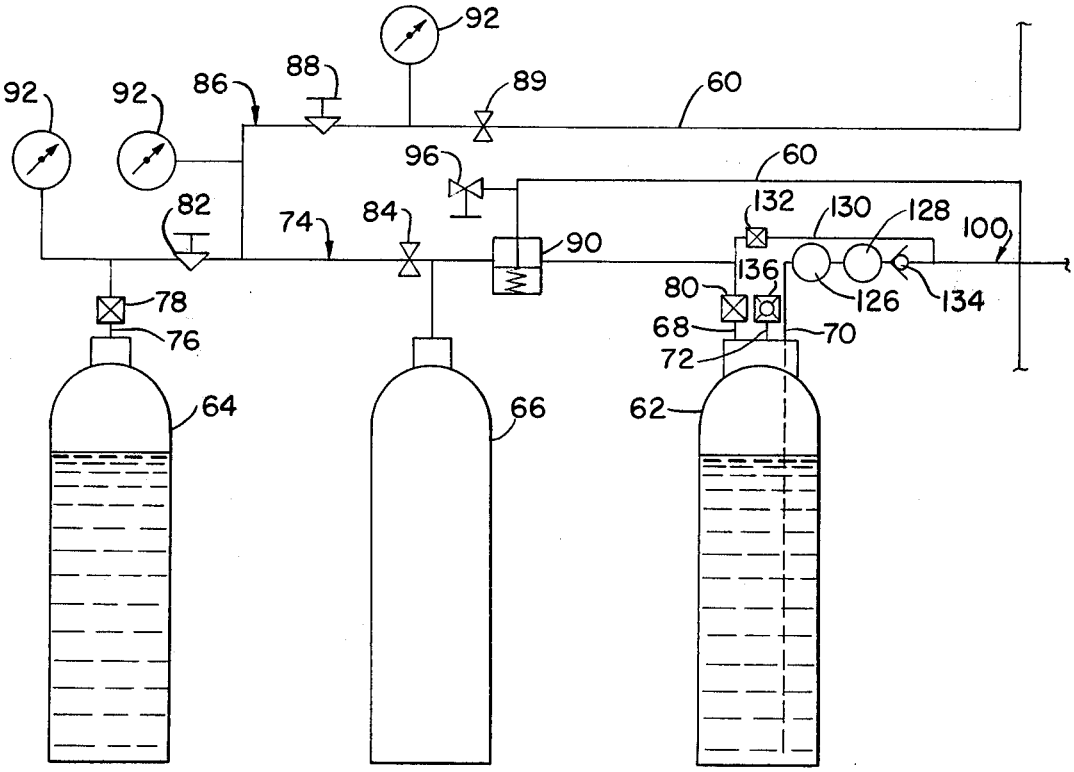
FIG. 6 is a schematic depiction of the fluid circuitry of a fire extinguishing system according to the invention.

The enclosure 32 carries an agent tank 62, and expellant tank 64, and an accumulator tank 66. The agent tank 62 is adapted to contain a supply of fire extinguishing agent such as, for example, a liquid halogenate hydrocarbon of the type sold under the trade name Halon 2402. The expellant tank is pressurized and contains liquid carbon dioxide which is discharged as a vapor. The agent tank 62 includes an expellant inlet port 68, an agent outlet port 70 and a fill port 72, 62 (FIG. 6).

An expellant supply conduit 74 extends from an outlet 76 of the expellant tank 64 to the inlet 68 of the agent tank 62. A manually actuable shutoff valve 78 is disposed at the outlet 76 of the expellant container 64, and a manually actuable shutoff valve 80 is arranged at the inlet 68 of the agent tank 62. A pressure regulator 82 of conventional construction is provided in the expellant conduit 74, so as to regulate pressure therein. In this regard, the expellant container 64 is normally maintained under high pressure, such as 1800 p.s.i. for example, depending upon temperature conditions. The pressure regulator 82 maintains a significantly lower pressure, such as 240 p.s.i., downstream thereof. These pressures are merely exemplative of a preferred system and are subject to variance.

A flow control member 84 is disposed in the expellant conduit 74 downstream of the pressure regulator 82. This flow control member is of conventional construction and includes a restricted passage which serves to meter the rate of flow of $CO_2$ vapor from the expellant tank 64. The flow control member 84 can be of the fixed, or variable restriction type.

Branching from the expellant conduit 74 at a location between the pressure regulator 82 and the flow control member 84 is a pilot conduit 86. A pressure regulator 88 is disposed in the pilot 86 conduit so as to maintain a reduced pressure, e.g., about 50 p.s.i., downstream thereof. A flow control member 89 is disposed in the pilot conduit 86 downstream of the pressure regulator 88 and serves to meter $CO_2$ vapor at a trickle-like rate. The pilot tubing 60 conducts the vapor through the mounting leg 34. From there, the pilot tubing loops around a portion or zone of the periphery of the tank rim, finally returning to the enclosure 32 through the same, or other, mounting leg 34. The pilot tubing 60 is in the form of flexible, heat sensitive plastic material which ruptures in response to a preselected intensity of heat, as can be generated by a rim seal fire. The pilot tubing 60 is connected to a pilot control valve 90 which is arranged in the expellant supply conduit 74 downstream of the flow control member 84. The control valve 90 is of conventional construction and is normally maintained in a closed position (FIG. 6) against an opening bias by pressure in the pilot tubing 60, so as to block communication between the expellant tank and the agent tank. Once this pressure is relieved, through, the control valve 90 is deactuated and is allowed to open.

Conventional pressure gauges 92 are disposed in the various conduits so that system pressure conditions can be continually visually monitored.

A manually actuable bleed valve 96 is disposed in the pilot conduit 86 upstream of the control valve to enable pressure therein to be relieved independently of the sensing of a fire.

The accumulator tank 66 communicates with the expellant conduit 74 at a point located between the control valve 90 and the flow control member 84. This accumulator 66 is of conventional construction capable of storing pressure. Thus, in the preferred system, the accumulator would be normally pressurized at 240 p.s.i.

A sprayer duct or conduit 100 extends from the agent outlet 70 and along the same zone covered by the pilot tubing 60. A plurality of sprayers 102, of a conventional type, are spaced along the sprayer conduit 100 in the protected zone.

Figure 5:
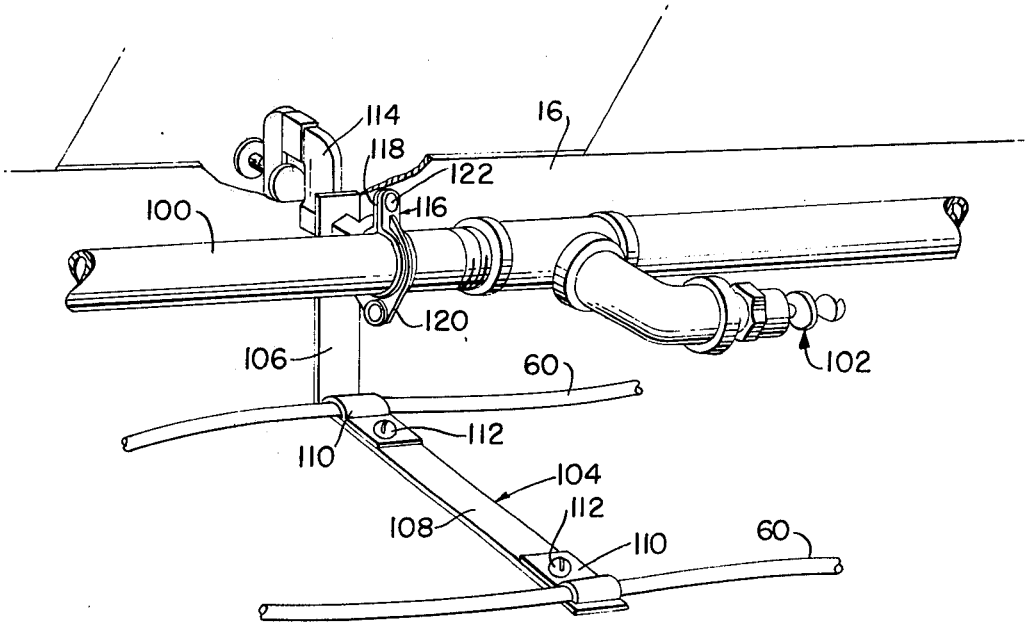
FIG. 5 is a detailed perspective view depicting the manner of securing pilot lines and a sprayer line of the present invention.

The manner in which the sprayer conduit 100 and the pilot tubing 60 are supported above the rim seal 14 is depicted in FIG. 5. An L-shaped bracket 104 is provided having an upstanding part 106 and a horizontal part 108. The horizontal part 108 contains a pair of eyelets 110 which retain the pilot tubing 60. The pilot tubing 60 may be replaced by removing fastener screws 112 which maintain the eyelets closed. The upstanding part 106 is clamped to the roof rim 16 by a conventional, manually operable clamp 114. A releasable support collar 116 is carried by the upstanding part 106 to receive the sprayer conduit 100. The collar includes a pair of pivotally joined sections 118, 120. A releasable fastener 122 maintains these sections closed. A plurality of similar brackets are arranged in spaced relation along the particular zone being protected.

The sprayer conduit 100 may be provided with a conventional pressure release valve, such as a rupture disc 126 (FIG. 6) which relieves excessive pressures occurring in the sprayer conduit 100. Also, a conventional strainer 128 is provided so as to catch the rupture disc pieces in the event that it ruptures.

A bypass conduit 130 is provided which communicates the expellant conduit 74 with the sprayer conduit 100 independently of the agent tank 62. This bypass conduit 130 communicates with the expellant conduit 74 at a point upstream of the shut-off valve 80. A manually operable shut-off valve 132 is provided in the bypass conduit 130 and is normally maintained closed. A one-way check valve 134 is disposed in the sprayer conduit 100 upstream of the point of communication of the bypass line with the sprayer conduit.

The fill port 72 of the agent tank is normally maintained closed by a pressure resistant plug 136 or the like of conventional construction. In order to replenish the container, it is merely necessary to open the fill port 72 and pour in additional agent. This can be done without the need for special equipment as would be required if the agent container was maintained under pressure.

As noted previously, each of the fire extinguishing systems 20, 22, 24 is independently operable, and each is oriented to protect a particular zone along the rim. Each system operates in an identical fashion, as will be hereafter discussed.

OPERATION

When the system 20 is operational, the valve 78 on the expellant tank 64 and the valve 80 at the inlet 68 of the agent tank are open; the valve 132 in the bypass conduit 130 is closed; and the pilot control valve 90 is closed by pressure in the pilot conduit 86. Pressure in the expellant conduit 74 between the pressure regulator 82 and the pilot control valve 90, and within the accumulator, is maintained at 240 p.s.i., and pressure in the pilot conduit 86 downstream of the pressure regulator 88 is maintained at about 50 p.s.i.

In the event that a rim seal fire breaks out, the pilot tubing 60 situated in that zone will become ruptured, thereby producing a sudden pressure drop at the control valve 90. Accordingly, the control valve 90 instantly snaps to an open condition. Rapid actuation of the control valve 90 is facilitated by the action of the flow control valve 89 which restricts vapor passage to a trickle. As soon as the control valve 90 opens, pressurized gas vapor from the accumulator 66 surges into the agent container 62, causing extinguishing agent to be propelled, during a first phase of displacement, at high speed to the sprayers. When accumulator pressurized gas from the accumulator 66 has been depleted, pressure from the expellant container 64 is admitted at a metered rate through the flow control member 84 to produce a continuous expulsion of extinguishing agent through from all of the sprayers 102 in that zone during a second phase of displacement. Travel of extinguishing agent during this second phase will be slower than during the first phase due to the action of the flow control member 84, to assure that spraying occurs for an extended period, preferably about 30 seconds.

By initially displacing the agent at high speed to the sprayers, it is assured that no delay is created in attacking the fire. Moreover, by thereafter spraying through all of the sprayers in the zone for an extended period, the danger of a low order fire migrating undetected along the rim seal is minimized. For example, in systems which employ individually actuated sprayers, a low order fire might activate one of the sprayers and yet continue to migrate along the rim seal. In the event that this fire does not activate an adjacent sprayer until after all the extinguishing agent has been expelled through the initially activated sprayer, the system will be ineffective to prevent further spreading of the fire within that zone. Also, protection is provided against a low order fire migrating from one zone and then returning to that zone. The 30 seconds of spraying time allows two adjacent systems to discharge with more than adequate time to prevent an elusive flame from moving back and forth between zones.

Once a system has depleted its supply of extinguishing agent, the agent tank 62 can be conveniently refilled by merely pouring in a new supply of extinguishant. Since the agent tank is normally unpressurized, this can be done without special equipment and by unskilled personnel.

Each system 20 may be periodically tested by closing the valve 80 at the inlet of the agent tank, opening the valve 132 in the bypass line 130, and opening the bleed valve 96 in the pilot conduit 86 to open the pilot control valve. Expellant pressure then travels through the bypass line 130 and is expelled through the sprayers. This activity can be monitored to assure that the system is operating properly.

The components of the system 20 are amply protected. That is, the overall design of the enclosure 32 and mounting legs 34, and the side-by-side positioning of tanks, 62, 64, 66 within the enclosure produces a relatively low center of gravity to minimize vulnerability of the enclosure to high winds. Moreover, by extending the pilot tubing 60 through the mounting leg 34 guards against accidental damage by rooftop personnel and equipment.

Although the invention has been described in connection with a preferred embodiment thereof, it will be appreciated by those skilled in the art that additions, modifications, substitutions and deletions not specifically described may be made without departing from the spirit and scope of the invention as defined in the appended claims.

What is claimed is:

1. A fire extinguishing system comprising:

a source of pressurized expellant fluid;

an agent container containing fire extinguishing agent, said agent being normally unpressurized; said agent container including an expellant inlet, an agent outlet and a fill port;

expellant conduit means for conducting expellant fluid from said expellant source to said expellant inlet of said agent container;

control valve means in said expellant conduit means, said valve means including a movable gate blocking communication between said expellant source and said agent container until a fire is sensed;

a sprayer duct connected to said agent outlet of said agent container and extending into an area being protected;

a plurality of sprayers connected to said sprayer duct, said sprayers having unblocked outlet means;

fire sensing means comprising a heat sensitive pilot conduit connected between said expellant conduit means and said control valve means, said pilot conduit being normally pressurized by expellant pressure to maintain said gate closed, said pilot conduit extending along said area being protected so as to be ruptured by a fire to relieve the pressure at said control valve means, thereby allowing said gate to open and admit expellant fluid to said agent container to pressurize the agent and discharge it through the sprayer duct and said sprayers;

pressure regulating means for maintaining fluid in said pilot conduit at less pressure than the fluid in said expellant conduit means; and means for exposing said agent fill port to allow replenishment of said agent container by the addition of unpressurized agent.

2. A system according to claim 1 further comprising bypass conduit means communicating said expellant conduit means with said sprayer duct, and valve means for blocking travel of expellant fluid into said agent container and admitting passage of expellant fluid through said bypass conduit to enable expellant fluid to be discharged from said sprayer duct during testing of the system.

3. A fire extinguishing assembly for floating roof tanks comprising:

a plurality of independently operable fire extinguishing systems for extinguishing fires within separate zones along the periphery of the tank roof, each said system comprising:

a source of pressurized expellant fluid;

an agent container containing fire extinguishing agent, said agent being normally unpressurized; said agent container including an expellant inlet, an agent outlet and a fill port;

expellant conduit means for conducting expellant fluid from said expellant source to said expellant inlet of said agent container;

control valve means in said expellant conduit means, said valve means including a movable gate blocking communication between said expellant source and said agent container until a fire is sensed;

a sprayer duct connected to said agent outlet of said agent container and extending only into an associated zone being protected;

a plurality of sprayers connected to said sprayer duct, said sprayers having unblocked outlet means;

fire sensing means comprising a heat sensitive pilot conduit connected between said expellant conduit means and said control valve means, said pilot conduit being normally pressurized by expellant pressure to maintain said gate closed, said pilot conduit extending only along said associated zone being protected so as to be ruptured by a fire to relieve the pressure at said control valve means, thereby allowing said gate to open and admit expellant fluid to said agent container to pressurize the agent and discharge it through only the sprayer duct and sprayers of said associated zone;

pressure regulating means for maintaining fluid in said pilot conduit at less pressure than fluid in said expellant conduit means; and means for exposing said agent fill port to allow replenishment of said agent container by the addition of unpressurized agent.

4. In a fire extinguishing system for floating roof tanks in which a source of fire extinguishing agent is disposed within a housing and is connected to a plurality of sprayers spaced along the periphery of the tank roof, and wherein pilot tubing of flexible, heat sensitive material is positioned in the area of said sprayers and is operably connected to a valve in said housing for allowing pressure expulsion of said agent through said sprayers in response to rupture of said pilot tubing by heat, the improvement wherein said housing comprises:

an enclosure containing a container of said agent, and a plurality of mounting legs extending substantially horizontally outwardly from said enclosure along said tank roof, the outer ends of said mounting legs being connected to said tank roof;

at least one of said legs including an inner passage having an inlet and outlet through which pilot tubing is protectively disposed.

5. Apparatus according to claim 4 wherein said legs each include first and second multi-sided telescoping sections, adjustable means being provided for securing said sections in different positions of adjustment to vary the effective length thereof.

6. Apparatus according to claim 4 wherein said one leg includes a lateral flange at its outer end, said flange being connected to an upstanding rim of said tank roof.

* * * * *